US008251404B2

(12) United States Patent
Depta et al.

(10) Patent No.: US 8,251,404 B2
(45) Date of Patent: Aug. 28, 2012

(54) DATA CARRIER WITH SECURITY ELEMENT AND METHOD FOR THE PRODUCTION THEREOF

(75) Inventors: Georg Depta, Rosenheim (DE); Karlheinz Mayer, Augsburg (DE)

(73) Assignee: Giesecke & Devrient GmbH, Munich (DE)

( * ) Notice: Subject to any disclaimer, the term of this patent is extended or adjusted under 35 U.S.C. 154(b) by 949 days.

(21) Appl. No.: 11/573,060

(22) PCT Filed: Jul. 28, 2005

(86) PCT No.: PCT/EP2005/008217
§ 371 (c)(1),
(2), (4) Date: Feb. 1, 2007

(87) PCT Pub. No.: WO2006/015733
PCT Pub. Date: Feb. 16, 2006

(65) Prior Publication Data

US 2007/0274559 A1 Nov. 29, 2007

(30) Foreign Application Priority Data

Aug. 6, 2004 (DE) ..... 10 2004 038 542

(51) Int. Cl.
*B42D 15/10* (2006.01)
*G09F 3/03* (2006.01)

(52) U.S. Cl. ..... 283/85; 283/67; 283/72; 283/94

(58) Field of Classification Search ..... 358/1.9; 264/400, 482; 283/72, 81, 85, 86, 67, 94; 101/19, 26, 3.1; 219/121.69, 121.8; 347/118, 347/137, 224, 241–245
See application file for complete search history.

(56) References Cited

U.S. PATENT DOCUMENTS

| | | | | |
|---|---|---|---|---|
| 4,234,214 | A | 11/1980 | Lee | |
| 5,975,583 | A | 11/1999 | Cobben et al. | |
| 6,372,394 | B1 * | 4/2002 | Zientek | 283/85 |
| 6,633,321 | B1 | 10/2003 | Maurer | |
| 2004/0050269 | A1 * | 3/2004 | Adamczyk et al. | 283/72 |
| 2004/0232691 | A1 * | 11/2004 | Lazzerini | 283/67 |

(Continued)

FOREIGN PATENT DOCUMENTS

CN 1248201 A 3/2000

(Continued)

OTHER PUBLICATIONS

International Search Report, International Application No. PCT/EP2005/008217, 3 pages, Nov. 17, 2005.

(Continued)

*Primary Examiner* — Edward Tolan
*Assistant Examiner* — Pradeep C Battula
(74) *Attorney, Agent, or Firm* — Greenlee Sullivan P.C.

(57) ABSTRACT

The present invention relates to a data carrier, especially a value document, such as a banknote, an identification card or the like, having a security element (20) that exhibits a print image (22) and a laser marking (24) at least partially overlapping the print image (22). According to the present invention, the security element (20) further exhibits, at least partially overlapping the print image (22), a laser modification area (26) that is in register with the laser marking (24) and in whose overlap area (28) with the print image (22) the visual appearance of the print image (22) is modified by the action of a laser beam.

27 Claims, 8 Drawing Sheets

U.S. PATENT DOCUMENTS

Figure 1:
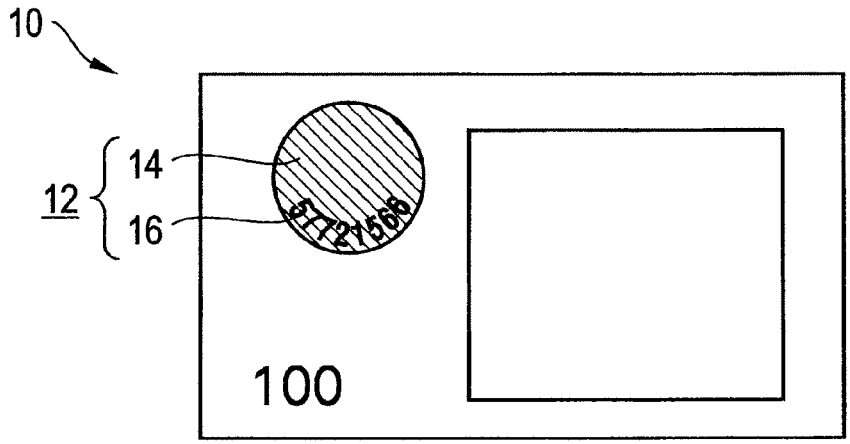

| | | | | |
|---|---|---|---|---|
| 2007/0165182 | A1 | 7/2007 | Hoffmuller | |
| 2007/0211238 | A1 | 9/2007 | Hoffmuller | |
| 2007/0216518 | A1 | 9/2007 | Hoffmuller | |
| 2007/0229928 | A1 | 10/2007 | Hoffmuller | |
| 2007/0241553 | A1 | 10/2007 | Heim | |
| 2007/0246933 | A1 | 10/2007 | Heim | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 * | 10/2008 | Depta et al. | 283/67 |
| 2008/0258456 | A1 | 10/2008 | Rahm | |

FOREIGN PATENT DOCUMENTS

| | | |
|---|---|---|
| EP | 1345166 | 9/2003 |
| EP | 1364809 | 11/2003 |
| WO | WO 00/43216 | 7/2000 |
| WO | WO 02/20274 | 3/2002 |
| WO | WO 03/023723 | 3/2003 |
| WO | WO 03/053714 | 7/2003 |
| WO | WO 2005105473 | 11/2005 |
| WO | WO 2005105474 | 11/2005 |
| WO | WO 2005105475 | 11/2005 |
| WO | WO 2005108106 | 11/2005 |
| WO | WO 2005108108 | 11/2005 |
| WO | WO 2005108110 | 11/2005 |
| WO | WO 2006005434 | 1/2006 |
| WO | WO 2006015733 | 2/2006 |
| WO | WO 2006018171 | 2/2006 |
| WO | WO 2006018172 | 2/2006 |
| WO | WO 2006040069 | 4/2006 |
| WO | WO 2006056342 | 6/2006 |
| WO | WO 2006072380 | 7/2006 |
| WO | WO 2006087138 | 8/2006 |
| WO | WO 2006099971 | 9/2006 |
| WO | WO 2006119896 | 11/2006 |
| WO | WO 2006128607 | 12/2006 |
| WO | WO 2007006445 | 1/2007 |
| WO | WO 2007006455 | 1/2007 |
| WO | WO 2007076952 | 7/2007 |
| WO | WO 2007079851 | 7/2007 |
| WO | WO 2007115648 | 10/2007 |

OTHER PUBLICATIONS

International Preliminary Report on Patentability, International Application No. PCT/EP2005/008217, 8 pages, Nov. 16, 2006.
U.S. Appl. No. 11/568,538, filed Sep. 23, 2008, Depta.
U.S. Appl. No. 11/719,843, in pre-exam, Kaule.
U.S. Appl. No. 11/909,115, filed Sep. 19, 2007, Kretschmar.
U.S. Appl. No. 11/995,227, in pre-exam, Gruszczynski.
U.S. Appl. No. 12/097,834, filed Jun. 17, 2008, Kaule.
U.S. Appl. No. 12/294,222, in pre-exam, Hoffmuller.

* cited by examiner

DATA CARRIER WITH SECURITY ELEMENT AND METHOD FOR THE PRODUCTION THEREOF

CROSS-REFERENCE TO RELATED APPLICATIONS

This application is the U.S. National Stage of International Application No. PCT/EP2005/008217, filed Jul. 28, 2005, which claims the benefit of German Patent Application DE 10 2004 038 542.4, filed Aug. 6, 2004, both of which are hereby incorporated by reference to the extent not inconsistent with the disclosure herewith.

The present invention relates to a data carrier, especially a value document, such as a banknote, an identification card or the like, having a security element that exhibits a print image and a laser marking at least partially overlapping the print image. The present invention further relates to a method for manufacturing such a data carrier, a method for manufacturing a data carrier having a security element having two imprinted print images, and a method for manufacturing a plurality of individual ups of data carriers on a sheet or a roll.

Data carriers within the meaning of the present invention especially include security or value documents, such as banknotes, passports, identification documents, check forms, stocks, certificates, stamps, vouchers, plane tickets and the like, as well as labels, seals, packaging and other elements for product protection. In the following, the term "data carrier" encompasses all such documents and product protection means.

Identification cards, such as credit cards or personal identity cards, have long been personalized by means of laser engraving. In personalization by laser engraving, the optical properties of the substrate material are irreversibly changed through suitable guidance of a laser beam in the form of a desired marking. Such a laser marking makes it possible to combine the individualization of the data carriers with security elements and to integrate them into the print image more freely than with conventional individualizations, for example with known numbering methods.

From publication U.S. Pat. No. 4,234,214 is known a banknote having a readable code composed of letters and numbers that comprises a sequential serial number for uniquely marking the banknote. The readable code is applied with a polychromatic background at a first position on the banknote in positive form and at a second position in negative form. Here, the negative form of the code can be produced by ablating a previously applied ink layer with a suitably controlled laser beam.

Since, when laser marking previously applied printing layers, the same paper path is used as with a printing machine, register variations of the same magnitude occur here as between standard printing methods. The register variations occur, for example, due to production tolerances in manufacturing printing materials, printing plates and printing screens, due to spacing variations of the printing area from the edges of the preprinted substrate when machines are changed between different printing methods, such as screen printing, simultaneous printing, intaglio printing and numbering, or because the dimensions of the substrate and the plates change in the printing process, for example in a rolling step, or the associated job steps, such as a drying step. In unfavorable cases, the register variations can be up to +/−3.5 mm. In general, in security printing, variations of +/−1.5 mm between background and intaglio printing can be expected, and of +/−2 mm between background and screen printing.

Foil elements can be applied with variations of +/−1.5 mm with respect to a background printing.

Such register variations stand out clearly primarily in round or curved printing elements that are marked along a concentric path or a path running along the curve.

Based on that, the object of the present invention is to specify a data carrier of the kind cited above, and a manufacturing method, with which the disadvantages of the background art are overcome. In particular, it is intended to avoid register variations between two print images or between a print image and a laser marking, or to make them largely invisible when viewed visually.

This object is solved by the data carrier having the features of the main claim. A method for its manufacture, a method for manufacturing a data carrier having a security element having two imprinted print images, and a method for manufacturing a plurality of individual ups of data carriers on a sheet or a roll are specified in the coordinated claims. Developments of the present invention are the subject of the dependent claims.

According to a first aspect of the present invention, the security element of a generic data carrier exhibits, at least partially overlapping the print image, a laser modification area that is in register with the laser marking and in whose overlap area with the print image the visual appearance of the print image is modified by the action of a laser beam.

In this aspect, the present invention is based on the idea of permitting register variations between the print image and the laser marking and, in a sub-area that is in register with the laser marking, modifying the visual appearance of the print image such that register variations between the print image and the laser marking recede into the background for the viewer and instead, the (perfect) register between the laser marking and the modification area dominate the optical appearance of the security element.

Here, in a preferred embodiment, it is provided that the laser modification area forms a contour of predefined width surrounding the edge of the print image. The characteristic dimension of the laser modification area, especially the predefined width of the surrounding contour, is expediently matched to the size of the register variations between the print image and the laser marking such that all typically occurring register variations can be compensated for.

The print image of the security element can be executed, for example, in screen printing, offset printing, indirect relief printing, relief printing, digital printing, or ink-receptive or relief-embossing intaglio printing. Combinations of printing methods can, of course, also be used.

Any printing inks can be used as printing inks, but preferably effect inks are used, which, due to their physical properties, lend the print image additional counterfeit protection and are difficult to imitate. The imprinted effect layer can especially consist of metal, a metallic ink or an ink containing interference layer pigments and be bronze, copper, silver or gold colored.

An ink mixture that exhibits a laser-radiation-absorbing mixture component and a laser-radiation-transparent mixture component can also be used as the printing ink. The laser marking of the print image then becomes visually perceptible due to a laser-induced irreversible change in the optical properties of the ink mixture. In particular, under the action of the laser radiation, the absorbing mixture component can be bleached, vaporized, changed in its reflection properties or transformed by a chemical reaction into a material having other optical properties.

Especially optically variable liquid crystal pigments are appropriate as the laser-radiation-transparent mixture component, and for the absorbing mixture component, optically variable interference layer pigments, for example. Other ink components that are irreversibly changeable in their optical properties, such as an intaglio ink, a metallic effect ink or metallic pigments, a luminescent ink or luminescent pigments, glossy pigments or a thermochromic ink, may also be used as the absorbing mixture component.

The print image can also consist of multiple stacked ink layers, at least one of the ink layers being laser-radiation-absorbing or including absorbing components. In this way, the visual design of the print image can be separated from the requirements for laser beam absorption.

Upon laser inscription, the layers disposed above an absorbing ink layer can be ablated together with said layer. In the print image, a liquid crystal layer can be provided above an infrared-absorbing printing layer, for example. The IR-transparent liquid crystal layer is then ablated together with the IR-absorbing background layer at the laser-exposed locations.

The print image can also include a liquid crystal layer above a thermochromic ink layer, the thermochromic ink layer being irreversibly blackened at the laser-exposed locations such that a clearly visible dark marking is created within the optically variable print image.

In a particular embodiment, the print image is designed as an oval or circle, and especially in the form of a coin likeness. This print image design is preferably combined with metallic-appearing printing inks, a foil patch element or a relief embossing. It is appropriate for the laser marking, through typical elements such as a centered portrait likeness or patterns or writing or number depictions around the edge, to take on and amplify the coin character.

In other, likewise advantageous embodiments, the print image forms a pattern, especially a line pattern, such as a Guilloché pattern composed of regularly interlaced lines. Other finely structured patterns such as are often used especially in security printing may also be used.

The laser marking of the security element can be designed in the form of patterns, characters or codes. In particular, the marking can consist of alphanumeric characters, such as are commonly used for serial numbers of value documents, or form a bar code, that is, a pattern sequence composed of bars and spaces that normally represent a binary numeric string. Two-dimensional codes, which offer particularly highly condensed recording, can also be used. Furthermore, the laser marking can include any symbols or graphic depictions that can be distributed practically without limits on the surface of the data carrier.

Within the laser marking or the laser modification area, different laser parameters can be used to achieve different effects or different effect intensities. For example, the line width of a line marking or the point size of a grid marking can be changed by focusing the laser beam. The focus can be changed with the requisite high speed via a motorized beam expansion in front of the scan head, or through so-called liquid lenses. Through different laser output, semitransparent areas can be produced next to areas having completely ablated printing ink. With the appropriate laser output, it is also possible to foam the substrate, which can lead to an easily perceptible tactility. The modulation frequency of the laser or the pulse sequence in pulse mode can be varied.

As already explained, the visual appearance of the print image is advantageously modified by the action of the laser beam also in the overlap area between it and the laser marking. In at least one of the overlap areas of the laser marking and the laser modification area with the print image, the printing ink of the print image can be partially or completely ablated by the action of the laser beam. A partial ablation can lead, for example, to lightened, bleached or semitransparent areas within the print image, with reduced thickness of the ink layer. The partial ablation can also consist in the introduction of a finely engraved pattern that forms, for example, a decorative edge around the print image. Likewise, the optical properties of the print image can be irreversibly changed in at least one of the overlap areas.

In an advantageous embodiment of the security element, the data carrier is not visually changed outside of the overlap area of the laser modification area and the print image. The effect of the laser modification is then limited to the area of the print image. Alternatively, the laser parameters for modification can be set such that, outside the overlap area of the laser modification area and the print image, a tangible marking having a relief structure is produced in the data carrier.

In a development of the present invention, below the print image is provided an ink layer, especially a security ink layer, that is exposed, activated or deactivated in at least one of the overlap areas by the action of the laser beam. For the security ink layer, for example, up-conversion materials, phosphorescent, fluorescent or other luminescent substances, magnetic inks, thermoluminescent or electroluminescent inks, as well as inks that absorb outside the visible spectral range may be used. In this way, machine-readable features can be introduced individually together with the laser marking or the laser modification. Further, with the aid of the security inks, it can be checked whether the security element is laser-marked.

The invention further includes a method for manufacturing a data carrier having a security element, in which a) a print image is imprinted on a data carrier substrate,
b) a laser marking at least partially overlapping the print image is produced by the action of a laser beam, and
c) by the action of a laser beam is produced, in register with the laser marking, a laser modification area at least partially overlapping the print image and in whose overlap area with the print image the visual appearance of the print image is modified.

The laser modification area is preferably produced in the form of a surrounding contour of predefined width around the edge of the print image. According to an advantageous embodiment of the method, the laser marking is produced in step b) having certain register variations between the print image and the laser marking, and the laser modification area is produced in step c) having a characteristic dimension that is matched to the size of the register variations, especially a predefined width of the surrounding contour that is matched to the size of the register variations.

The laser marking and the laser modification area are advantageously produced in the same operation with the same laser marker such that they are in perfect register with one another.

The laser marking and the laser modification area can be produced in any sequence. In some embodiments, however, it is advantageous for the laser modification area to be produced first, and the laser marking then formed at least partially within the laser modification area.

The laser marking and the laser modification area are preferably produced for a plurality of individual ups of data carriers on a sheet or a roll.

The invention further includes a method for manufacturing a data carrier having a security element, in which a) a first print image is imprinted on a data carrier substrate,
b) a second print image is imprinted on the data carrier substrate, the two print images exhibiting certain register variations, and
c) by the action of a laser beam, a laser modification area at least partially overlapping the two print images is produced in whose overlap area with the print images the visual appearance of each print image is modified.

Here, the laser modification area in step c) is advantageously produced having a shape and size that is matched to the size of the register variations.

Within the meaning of the present invention, the first or the second print image can be produced with any suitable printing methods, especially with those mentioned above, "print image" being intended to also mean a relief embossing, preferably produced in non-ink-receptive intaglio printing.

In a further aspect, the present invention includes a method for manufacturing a plurality of individual ups of data carriers on a sheet or a roll, in which a) on the sheet or the roll is imprinted an overall print image that comprises the print images of multiple individual ups,
b) the position of the print images on the sheet or the roll is detected, and
c) based on the detected position of the print images, laser markings are produced in the individual ups by the action of a laser beam.

In a preferred embodiment of the method, in step a), on the sheet or the roll are printed, together with the print images, register marks, especially register lines or register crosses, whose positions are detected in step b) as a gauge for the position of the print images.

Here, in a variation of the present invention, with every print image is printed an associated register mark whose position is detected in step b) as a gauge for the position of the associated print image. Here, the detection can occur in only one direction in space, such as the direction of movement of the sheet or the roll, or in two directions in space. In the last case, advantageously, register crosses are used as register marks, and in the first case, register lines suffice.

According to another variation, for each of a group of print images, for example for a row of ups, an associated register mark is printed whose position is detected in step b) as a gauge for the position of the print images of the associated group. Here, however, the lower outlay is met with lower detection precision.

The position of the register marks in step b) can advantageously also be detected by imaging sensors, especially by line scan cameras or area scan cameras.

Alternatively, in step b), the imaging sensors can also detect the positions of the print images from characteristic features of the print images, so without using register marks. In this case, additionally, data in the print images can be read by the imaging sensors in step b) and, based on this data, the information content of the laser marking defined. In step c), laser markings having information content defined in this way are then produced in the individual ups.

As the laser source for the marking or modification of the print image, advantageously, an infrared laser in the wavelength range from 0.8 μm to 3 μm, especially a Nd:YAG laser is used. To accommodate the high processing speeds in security printing, when marking, the laser beam is expediently guided across the security substrate at a speed of more than 1000 mm/s, preferably of more than 2000 mm/s, particularly preferably of about 4000 mm/s or more.

Further exemplary embodiments and advantages of the present invention are explained below by reference to the drawings, in which a depiction to scale and proportion was omitted in order to improve their clarity.

Figure 2A:
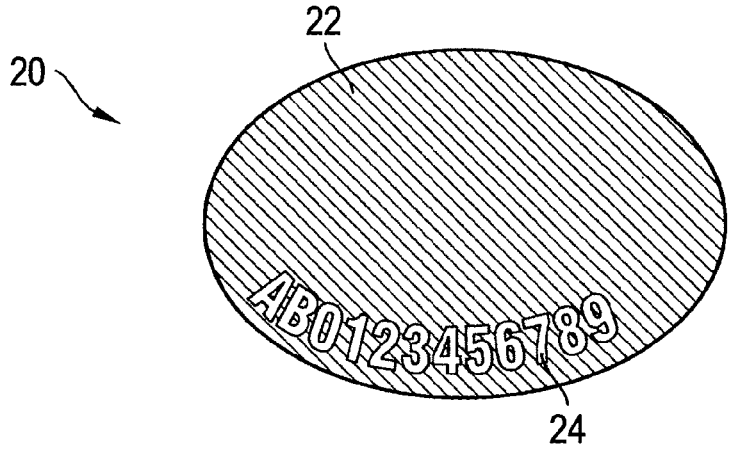
Figure 2B:
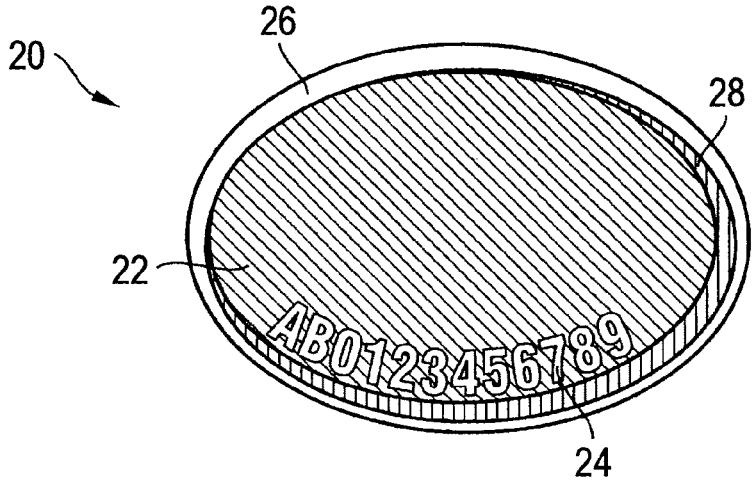
Figure 3:
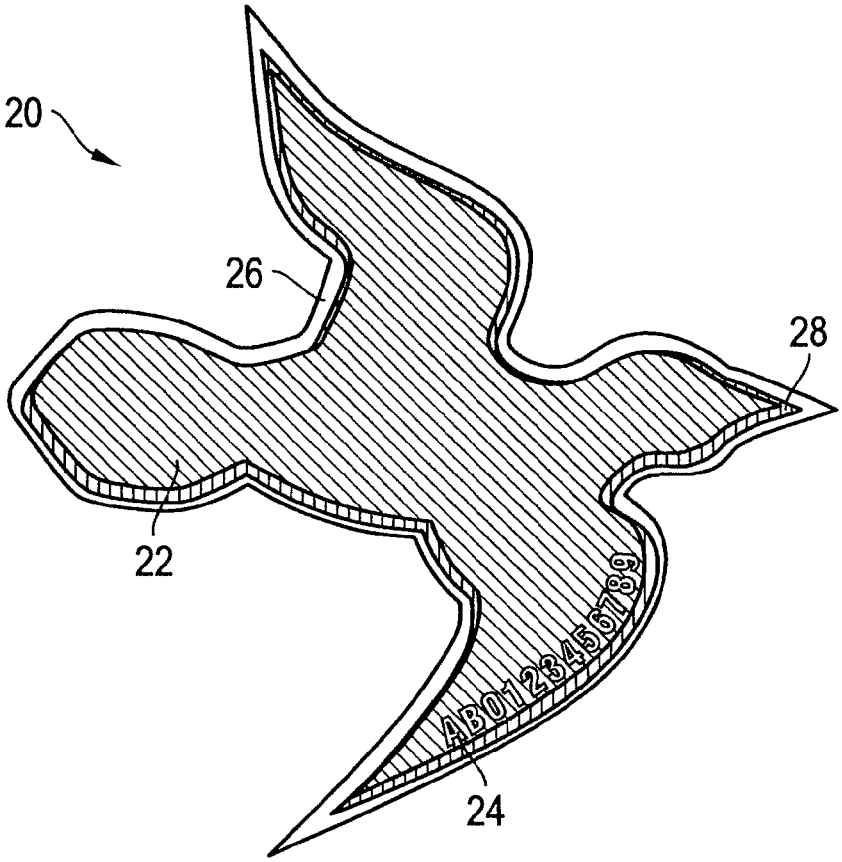
Figure 4:
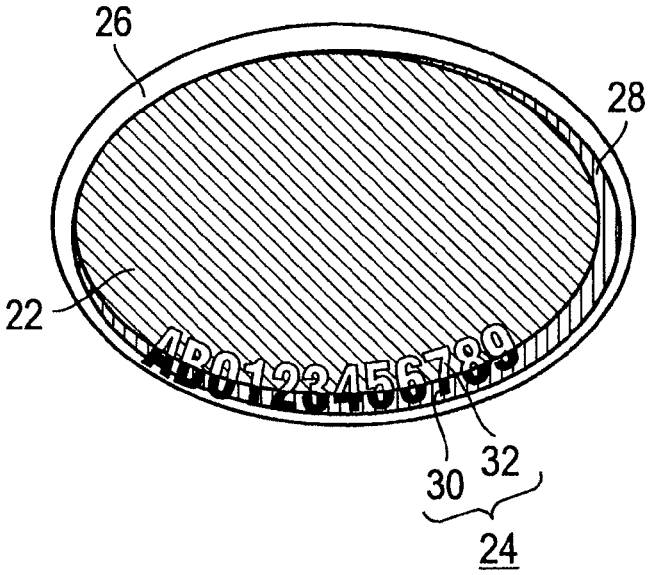
Figure 5A:
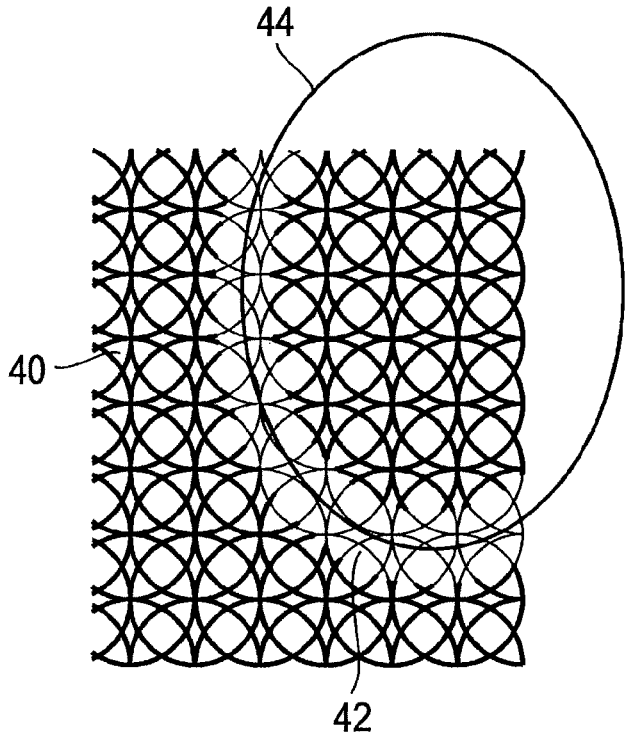
Figure 5B:
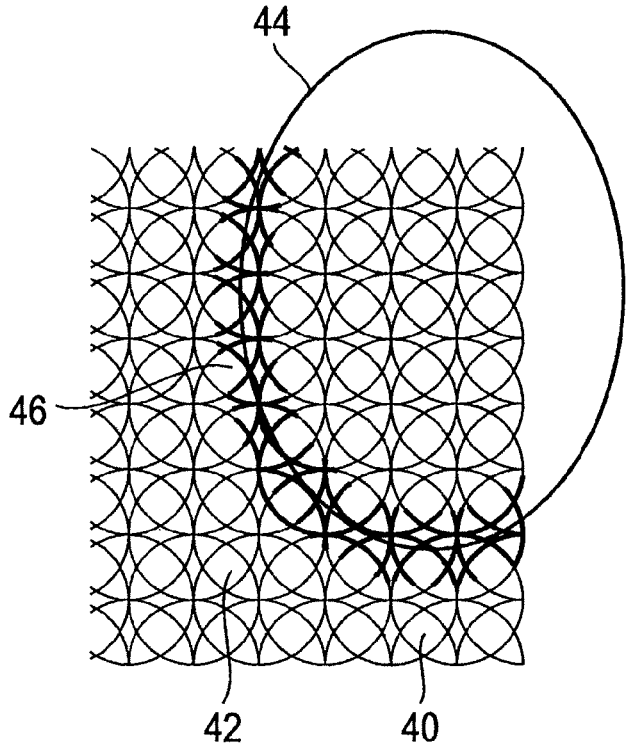
Figure 6:
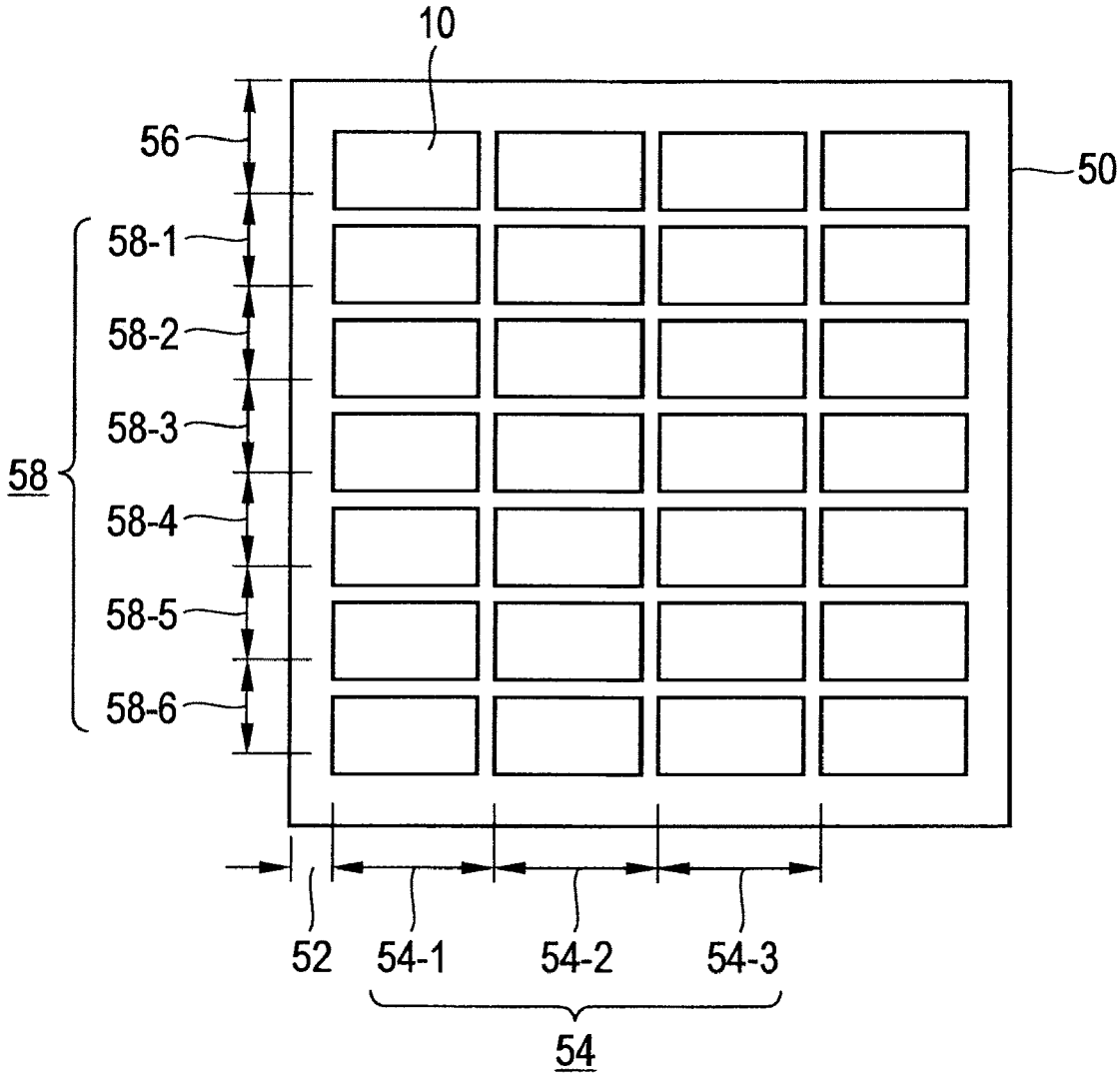
Figure 7A:
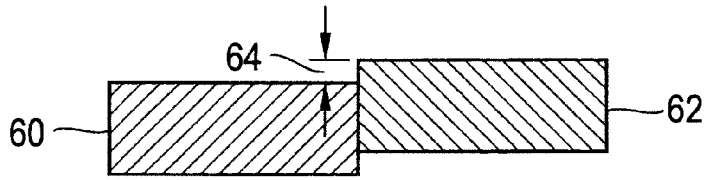
Figure 7B:
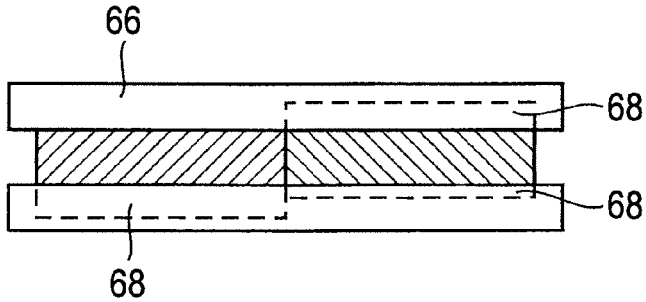
Figure 7C:
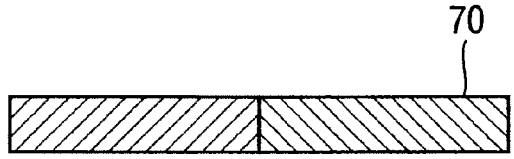
Figure 8:
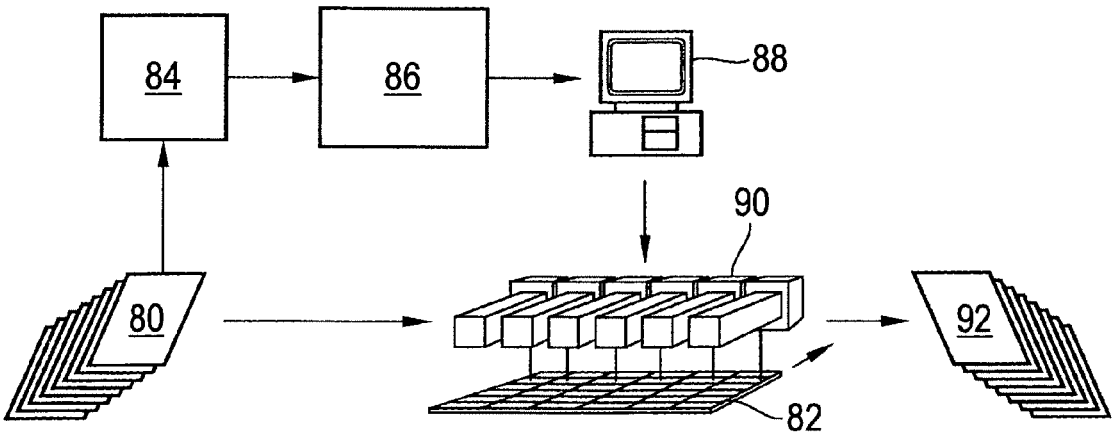
Figure 9:
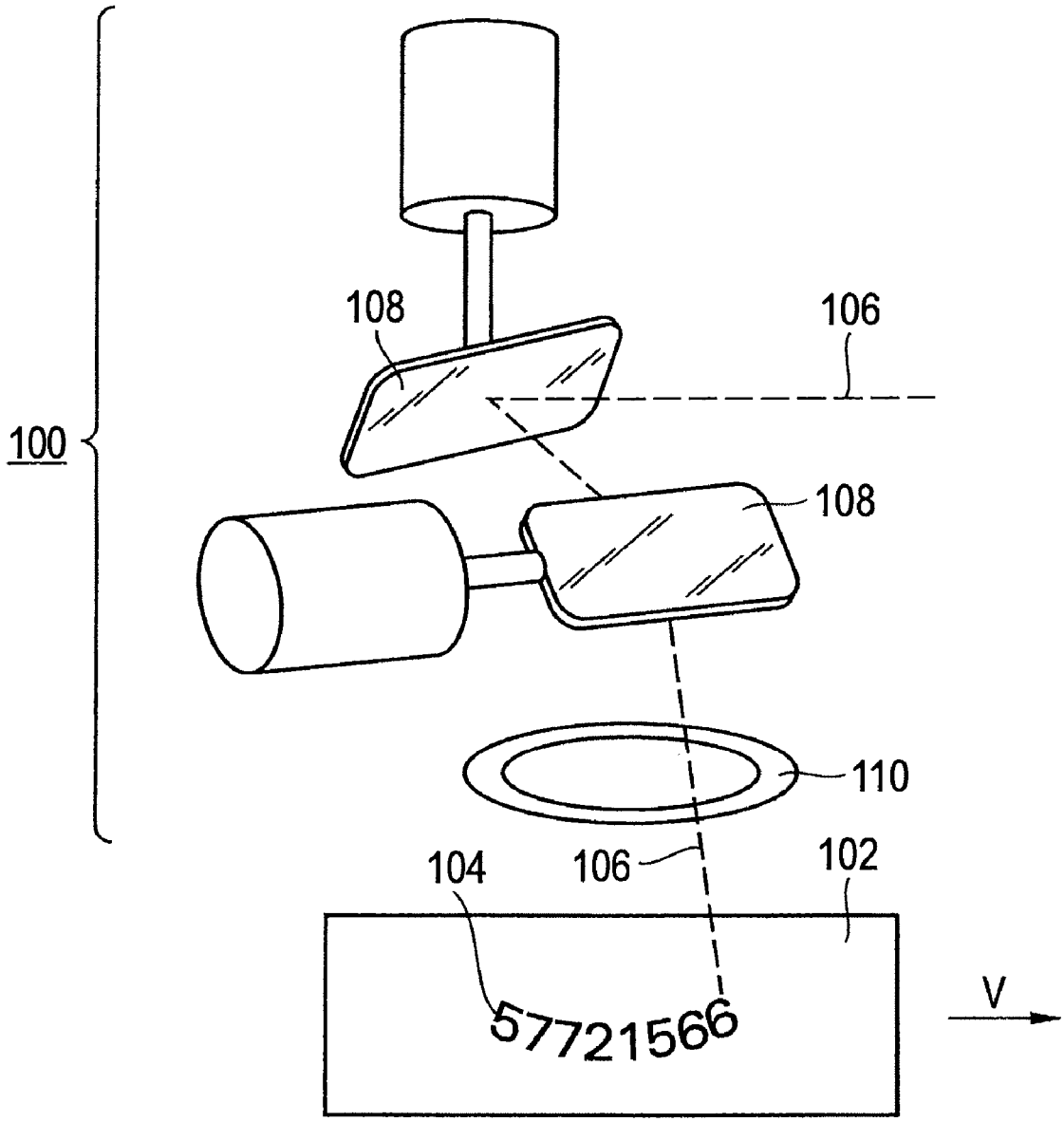
Figure 10:
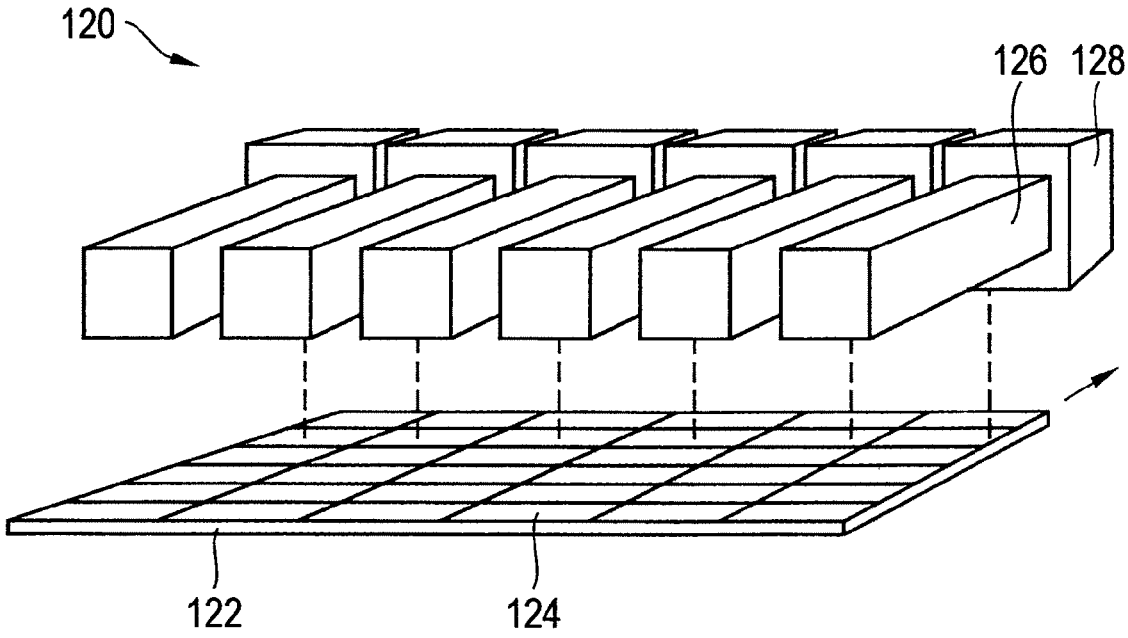
Figure 11:
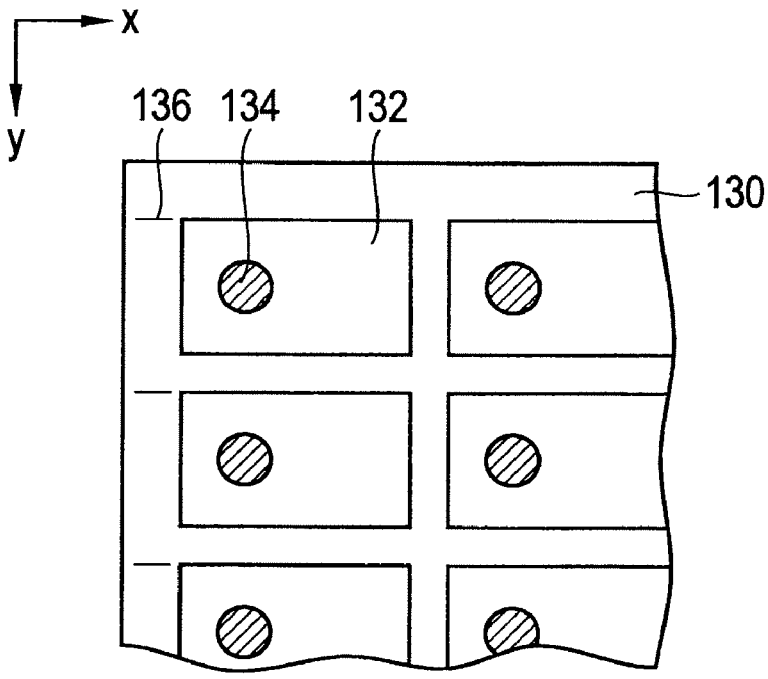
Figure 12:
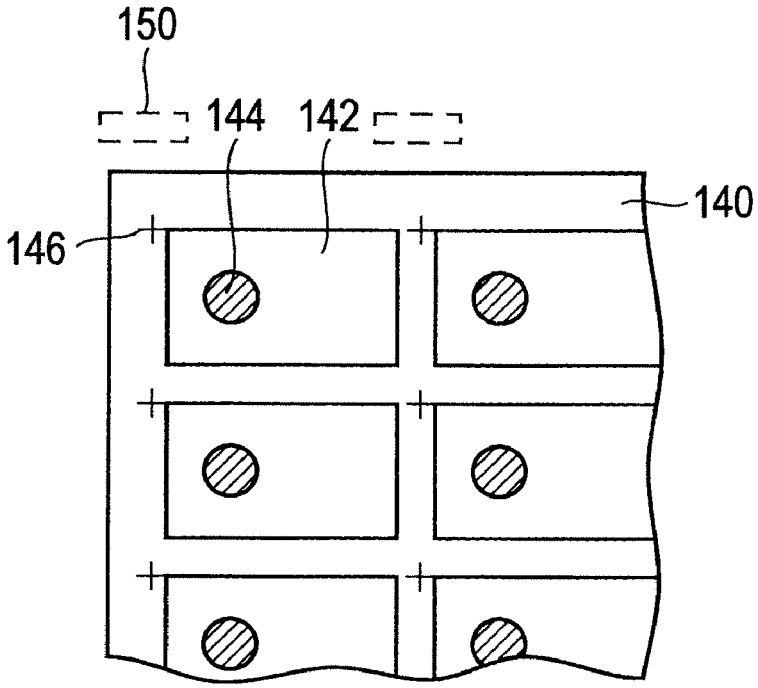

Shown are:

FIG. 1 a schematic diagram of a banknote, according to an exemplary embodiment of the present invention, that is provided with a security element in the shape of a coin FIG. 2 in (b), a schematic diagram of a security element according to the present invention, and in (a), an intermediate step in its manufacture, FIG. 3 to 5 further exemplary embodiments of security elements according to the present invention having perfect register between the print image and the laser marking, FIG. 6 a sheet having a plurality of individual ups and plotted spacings of the planned laser markings, to explain a method according to the present invention, FIG. 7 in (a) to (c), three steps in compensating the register variations of two print images of a security element with the aid of a laser modification area, FIG. 8 a block diagram to explain a method according to the present invention in which the positions of the print images are detected by sensors, FIG. 9 a schematic diagram of a vector laser coder to explain its operating principle FIG. 10 a schematic diagram of a vector laser coder for inscribing a security sheet, FIG. 11 a section of a security sheet having a plurality of individual ups and having register lines at each row of ups, and FIG. 12 a section of a security sheet as in FIG. 11, having register crosses at each individual up.

The invention will now be explained using a banknote as an example. FIG. 1 shows a schematic diagram of a banknote 10 that is provided with a security element 12 in the form of a coin. The security element 12 exhibits a circular print image 14 that is imprinted by means of screen printing technology with a metallic ink, for example a silver ink, on the banknote substrate.

Further, the security element 12 is provided with a laser marking 16, for example a serial number, that runs along the curve of the print image 14. To increase the coin character of the security element 12, it is typically provided with further graphic motifs or alphanumeric elements, which are not depicted in FIG. 1. To increase counterfeit security, the laser-produced motifs of the coin 12 can be applied repeatedly to the banknote with other techniques, for example as a die-stamped motif or as a watermark.

In their visual appearance, the print image 14 and the laser marking 16 are in perfect register with one another. The present invention provides two ways to achieve this registration.

First, the procedure according to the first aspect of the present invention is explained with reference to FIGS. 2 to 6. For this, FIG. 2 shows, in (a), a security element 20 having an oval print image 22 that is provided with a laser marking 24. Due to the above-described register variations between the print image and the laser marking, the alphanumeric marking 24 does not precisely follow the curve of the print image 22. Although the size of the deviation is depicted exaggeratedly in FIG. 2(*a*) for illustration, the human eye is very sensitive to such deviations, particularly in round or curved elements, such that even relatively small deviations can stand out intrusively.

According to the present invention, the security element is thus, as shown in FIG. 2(*b*), additionally provided with, partially overlapping the print image, a laser modification area 26 that forms a contour surrounding the edge of the print image 22. In the overlap area 28 of the laser modification area 26 with the print image 22, the printing ink of the print image is ablated or transformed into a transparent modification. Here, the laser modification area 26 is in perfect register with the laser marking 24, since it is produced together with same in the same operation by the same laser marker and controlled by the same computer. Here, the ablation of the printing ink can occur in that the laser beam is directed directly at the printing ink and acts from the side on which the printing ink is located. Alternatively, the laser beam can also act on the reverse, i.e. on the surface of the substrate facing away from the printing ink, and achieve the desired effects on the side of the substrate on which the printing ink is located.

When the finished security element 20 in FIG. 2(*b*) is viewed, the visual impression of perfect register of the laser marking 24 and the still visible portion of the print image 22 results. Such perfect register in curved elements constitutes an obstacle that is very difficult for counterfeiters to overcome and, particularly due to the aforementioned sensitivity of the human eye to small register variations, forms a security element with high counterfeit security.

The sequence in which the laser marking 24 and the laser modification area 26 are produced is, in principle, arbitrary. As explained below, depending on the desired effect, it can be advantageous to produce first the laser marking 24 or first the laser modification area 26.

The print image 22 to be provided with the laser marking can be exposed or surrounded by adjacent print images. In the latter case, it is advantageous for the printing inks of the adjacent print images to be laser-radiation transparent such that, depending on the laser parameters used in producing the laser modification area 26, no marking or a tangible marking is created there.

FIGS. 3 to 5 show further exemplary embodiments of security elements according to the present invention having perfect register between the print image and the laser marking. As the exemplary embodiment in FIG. 3 shows, in which the same reference numbers as in FIG. 2 indicate identical elements, the principle described can also be applied to security elements 20 having complex shapes. Instead of ablating the printing ink contiguously in the overlap area 28, a decorative edge 28 can also be produced around the print image 22 through suitable control of the laser writer. Optically, the contiguous inside of the print image dominates such that here, too, the impression 22 of perfect register between the print image and the laser marking is created.

As shown in the exemplary embodiment in FIG. 4, the laser marking 24 can also be guided beyond the edge of the print image 22, where it effects a marking effect in the data carrier substrate, for example a blackening 30. In this way, special contrast effects can be produced. For example, the marking portion 32 that overlaps with the print image 22 and in which only the printing ink is removed and the remaining laser energy is not sufficient to blacken the substrate appears white against the silver- or gold-colored background of the print image 22, while the laser effect outside the print image 22 causes a blackening 30 of the otherwise light substrate material.

In designs having laser markings protruding beyond the edge of the print image, the laser modification area is advantageously produced first to ensure that the location of the shift in contrast or color coincides with the edge of the remaining print image.

In the further variation of the present invention depicted in FIG. 5, the impression of registration of print image and laser marking is created in that, in the print image or in the substrate of the data carrier, an areal change is created with a first set of laser writer parameters and then, in the laser modification area produced in this way, with a second set of parameters, a laser marking having an effect that differs from the areal change is produced in register. The areal change can consist, for example, in a removal of ink or ink components, or a lightening or bleaching.

In the exemplary embodiment shown in FIG. 5(*a*), the line print pattern 40 is lightened in the laser modification area 42 and a tangible marking 44 is produced in register therewith at significantly higher laser intensity. As the exemplary embodiment in FIG. 5(*b*) shows, the areal change 42 can also leave in the print pattern 40 a print image area 46 in which the laser marking 44 is then produced.

As already explained under FIG. 2, the laser beam can be guided on the front or on the reverse of the substrate.

With reference to FIG. 6, when manufacturing a plurality of individual ups of banknotes 10 on a sheet 50 or a roll, the laser process is initiated once per sheet or roll. If the start signal is given at the upper left corner of the sheet, the spacings 52 (in the x-direction) and 56 (in the y-direction) lead to the security element to be marked in the first banknote.

In a dummy sheet, the spacings 54-i, i=1 . . . 3 (in the x-direction) and 58-j, j=1 . . . 6 (in the y-direction) between the security elements to be marked are constant, and the production of the laser markings and the laser modification areas then occurs with predefined fixed spacings 54 and 58. Here, the precision of the lasering in relation to the print image is on the same order as for a conventional numbering. However, since, for the viewer, the laser marking is put into visual relationship with the laser modification area produced in the same job step, practically no register variations are perceptible for the viewer.

However, for the trained eye or with the aid of optical devices, it can be proven beyond doubt, for example on the basis of adhesive residues, that the security element was provided with a laser-produced register. Also, substances that are invisible to the human eye can be systematically introduced into the printing layer or a layer lying thereunder. In this way, the presence or absence of a laser modification can serve as an additional security feature.

If necessary, the coordinates of the elements to be marked can also be detected more precisely. For example, the spacings 54-1, 54-2, 54-3 . . . (in the x-direction) and 58-1, 58-2, 58-3 . . . (in the y-direction) between the sheet elements to be marked can be determined individually on the resting sheet and entered into the control unit of the laser marker to compensate for changes in the length and/or width of the sheet 50. Here, the position measurement can be done individually for columns and rows or even individually for each up, resulting in spacings 52-i, 54-i1, 54-i2, 54-i3, . . . , for the i-th up row being obtained in the x-direction, and spacings 56-j, 58-j1, 58-j2, 58-j3, . . . , for the j-th up column in the y-direction.

The above-described approach can also be used to manufacture a data carrier having a security element having two print images, in which the two print images initially exhibit certain register variations.

For this, FIG. 7 shows, in (a), two print images 60 and 62 having register variations 64 and imprinted in succession on a data carrier substrate. By the action of a laser beam, a laser modification area 66 overlapping the two print images 60, 62 is produced in whose overlap area 68 with the print images the printing ink of the appropriate print image 60 or 62 is ablated, as shown in FIG. 7(*b*). The laser parameters are selected such that the data carrier substrate is not changed outside of the overlap area 68. Thus, the registered transition 70 depicted in FIG. 7(*c*) remains. It is understood that this method can also be applied to more than two print images. Here, the print images can be applied on the front and/or reverse.

According to the further aspect of the present invention, register variations between the print images of a sheet or a roll and the appropriate laser markings are avoided in that the positions of the print images or certain elements of the print images are detected by sensors, and the laser markings are produced based on the detected positions.

The basic procedure is illustrated in the block diagram in FIG. 8. The method begins at reference number 80, where the sheet feed into the machine takes place. The sheets 82, each of which includes a plurality of individual ups of data carriers, are processed with a certain web or sheet speed 84. The speed is, for example, about 10,000 sheets/hour, which, depending on the design, corresponds to web speeds of 2 m/s to about 3.5 m/s. Such web speeds are also achieved when processing web-shaped materials. The coordinates of pre-printed register marks or certain points in the print image of the individual ups are detected (reference number 86) and transmitted to a computing unit 88 to determine the marking positions. The computing unit 88 controls a laser marker 90, described in greater detail below, to apply the laser markings in the correct positions within the print image of each individual up. Lastly, the marked sheets are output at reference number 92.

FIG. 9 shows schematically the scan head 100 of a vector laser coder with which the security element 102 of an individual up is provided with a laser marking 104. An infrared laser beam 106 is deflected via two movable mirrors 108, one of the mirrors producing the deflection in the x-direction and the other mirror the deflection in the y-direction. A plane-field lens 110 focuses the laser beam 106 on the security element 102, where it produces, in the manner described above, the laser marking 104 and possibly also a laser modification area.

The security element 102 and the data carrier substrate move during the marking operation at a certain speed v. This speed is detected by sensors (reference number 84 in FIG. 8) and transmitted to the computer 88 (FIG. 8) to control the movement of the mirrors 108 such that the substrate speed v is compensated for when inscribing. The marking method can thus be employed particularly advantageously for the non-contact marking of value documents that are processed at high speeds, as is common in printing shops.

The security elements 102 of a sheet can also be marked, for example, by means of a matrix of punctiformly emerging laser beams or by means of large-cross-section beams that are partially covered by a stencil. Such stencils can be implemented to be automatically variable. If it is not possible or not desired to guide the radiation in line with the substrate speed, it is also possible to mark moving substrates by choosing a short exposure time. Beam control through polygon mirrors is also possible.

Depending on the substrate used, $CO_2$ lasers, Nd:YAG lasers or other laser types in the wavelength range from UV to far infrared may be used as the radiation sources, the lasers also often working advantageously with frequency doubling or tripling. Preferably, however, laser sources in the near infrared are employed, since this wavelength range is well suited to the absorption properties of the data carrier substrates and printing inks used. Depending on the application, the spot size of the laser radiation can be varied from a few micrometers to a few millimeters, for example by changing the distance between the plane-field lens 110 and the security element 102. Preferably, spot sizes of around 100 μm are used.

The continuous output of the laser marker used typically lies between a few watts and a few hundred watts. Nd:YAG lasers can be operated with laser diodes for lower total output with smaller construction dimensions and high beam quality, or with pump lamps for high outputs. In order to not reduce the speeds of an industrial value document production line, the laser markings or laser modifications are advantageously executed with very fast-moving galvanometers that can guide the beam across the substrate at more than 1000 mm/s, preferably at up to 4000 mm/s or more. At these marking speeds, only a small proportion of energy is deposited in the substrate or the security element 102 for each section, so that, advantageously, lamp-pumped Nd:YAG lasers with an output of about 100 watts are used.

By varying the inscription parameters, such as the laser output, exposure time, spot size, inscription speed, operating mode of the laser, etc., the marking results can be varied within a broad scope. In this way, in addition to the partial or complete ablation or the partial or complete modification of ink or effect layers, other markings, such as blackenings in the data carrier substrate or tangible markings having a relief structure, can also be produced by the laser. Such tangible markings preferably have a height of 30 to 100 μm.

The markings are undertaken for example with a Nd:YAG laser having a fundamental wavelength of 1064 nm and exhibiting an average output of 26 W and a modulation frequency of 8 kHz. The diameter of the laser beam on the substrate (spot size) is about 100 μm and the traverse speeds of the laser beam across the substrate 250 to 4000 mm/s.

FIG. 10 shows a laser marker 120 in which, with a plurality of lasers, a sheet 122 is simultaneously provided with a laser marking and a laser modification area. In the example shown, the sheet 122 exhibits six columns and six rows such that 36 individual ups 124 of bank notes or other data carriers are disposed on this sheet. For each column, disposed above the printing sheet 122 is a laser tube 126 that, together with the associated scan head 128, produces the laser markings or modifications in each of the individual ups 124 disposed in that column. The throughput can be greatly increased through this configuration since a single laser beam does not have to be moved across the entire printing sheet, but rather merely one scanning field is impinged on between the columns of the printing sheet. The impingement on the individual ups occurs, as described for FIG. 9, through the deflection of the laser radiation by means of the mirrors contained in the scan heads 128.

An exemplary embodiment for the detection of the position of the print images of the individual ups will now be explained with reference to FIG. 11. For the following description, the y-coordinate is selected to be along the column direction of the individual ups, and the x-coordinate along the row direction.

As shown in FIG. 11, for each column of individual ups 132 having print images 134 to be marked, an associated register line 136 is printed on the sheet 130. A printing mark or contrast mark sensor detects the register line 136 prior to the laser inscription and controls the y-coordinate of the marking accordingly. The register line 136 is printed in the printing process to which the laser is to be matched, so that it is subject to the same register variations as the print images 134 of the row of ups. If the length of the printing sheet is changed in the column direction, for example by drying or rolling out, this can be accounted and compensated for by detecting the position of the register lines 136 for the associated print images 134.

Here, an associated register line can also be printed for each individual up. The register lines can then be detected and analyzed individually for each column of ups, thus achieving greater precision for a non-uniform change in the y-coordinate across the row direction x, for example due to non-uniform drying or trapezoidal rolling.

Instead of the register lines, distinctive points in the print image of the data carrier can often also be used for detection. The individual ups can then be arranged to save space on the sheet.

FIG. 12 shows a sheet 140 in which, for each individual up 142, an associated register cross 146 is printed. This permits, in addition to the y-coordinate, the position of the print images 144 to be determined in the row direction x. To be able to use a contrast mark sensor here, too, the scanning light beam can be guided, for example with the aid of a polygon wheel, perpendicular to the direction of movement of the sheet, the shortest traverse paths possible being selected to avoid imprecisions.

The scanning in the x-direction, as well as in the y-direction, can also occur with the aid of imaging sensors, for example with a CCD or CMOS line scan camera. The scanning frequency of such sensors is high enough to be able to detect each individual up despite the high web speeds. To detect register marks 146 or distinctive points in the print image 144, advantageously, one row is used per column of ups, as denoted by the line scan cameras 150 plotted in dotted lines in FIG. 12.

The individual rows read out can either be processed directly or, with the aid of a meter defined by the speed measurement of the sheets, assembled into images and then analyzed. The analysis is done with special hardware and/or software, particularly digital signal processors and PGA (programmable gate array) components being suitable. Due to the requisite short exposure times, very bright and well-adjusted lighting is recommended, such as flash bulbs that are switched synchronously with the image feed.

Instead of line scan cameras 150, area scan cameras that record two-dimensional information can also be used. In this way, the print image of the overall appearance can be detected. To achieve high resolution and thus good register precision, here, too, it is appropriate to use one area scan camera per column of ups. In particular, CMOS cameras are appropriate here, as these achieve high scanning frequencies with high resolution, and support fast signal processing well. Otherwise, the above details apply with regard to signal processing and lighting.

Since area scan cameras detect the entire print image, also less distinctive points in the print image can be detected and used as the basis for position determination. The subsequent data processing is then easier to realize. Furthermore, the detected images can serve as a quality control for preceding printing operations.

In the variations in which imaging sensors are used to determine position, they can additionally read print image data that determine or co-determine the information content of the laser marking.

For example, a camera can read in the print image a numeric string applied in letterpress printing, and the read data can be used to produce an appropriate matrix code having the same information content and introduce it as a laser marking into the print image of this individual up. The information content of the laser marking can also be merely derived from the read information content and, for example, constitute a check digit for the read numbering, or repeat a portion of the read numbering.

The invention claimed is:

1. A data carrier, especially a value document, having a security element that comprises a print image and a laser marking, wherein the laser marking is at least partially overlapping the print image, register variations existing between the print image and the laser marking, wherein the laser marking is produced by a first laser action, characterized in that the security element further comprises a laser modification that is in register with the laser marking; wherein the laser modification is at least partially overlapping the print image, and in the overlap area of the laser modification and the print image, the visual appearance of the print image is laser modified, wherein the laser modification is produced by a second laser action;

wherein the print image, the laser marking, and the laser modification are arranged on the same side of the data carrier; and wherein the laser modification forms a contour of predefined width surrounding the entire circumferential edge of the print image.

2. The data carrier according to claim 1, characterized in that a characteristic dimension of the laser modification, wherein the characteristic dimension is the predefined width of the surrounding contour, is matched to the size of the register variations between the print image and the laser marking.

3. The data carrier according to claim 1, characterized in that the print image is imprinted by means of screen printing, offset printing or relief printing.

4. The data carrier according to claim 1, characterized in that the print image is an effect layer.

5. The data carrier according to claim 4, characterized in that the effect layer consists of metal, a metallic ink or an ink containing interference layer pigments.

6. The data carrier according to claim 4, characterized in that the effect layer is bronze, copper, silver or gold colored.

7. The data carrier according to claim 1, characterized in that the print image is designed as an oval or circle, especially in the form of a coin likeness.

8. The data carrier according to claim 1, characterized in that the print image forms a pattern.

9. The data carrier according to claim 8, wherein the pattern is a line pattern.

10. The data carrier according to claim 8, wherein the pattern is a Guilloché pattern.

11. The data carrier according to claim 1, characterized in that the laser marking is designed in the form of patterns, characters or codes.

12. The data carrier according to claim 1, characterized in that, in the overlap area of the laser marking and the print image, the visual appearance of the print image is modified by the action of a laser beam.

13. The data carrier according to claim 1, characterized in that in at least one of the overlap areas of the laser marking and the laser modification with the print image, the printing ink of the print image is partially or completely ablated by the action of a laser beam.

14. The data carrier according to claim 13, characterized in that the print image is lightened or bleached in at least one of the overlap areas.

15. The data carrier according to claim 13, characterized in that the optical properties of the print image are irreversibly changed in at least one of the overlap areas.

16. The data carrier according to claim 1, characterized in that the data carrier is not visually changed outside of the overlap area of the laser modification and the print image.

17. The data carrier according to claim 1, characterized in that, outside the overlap area of the laser modification and the print image, the data carrier exhibits a tangible marking having a relief structure.

18. The data carrier according to claim 1, characterized in that below the print image is provided an ink layer that is exposed, activated or deactivated in at least one of the overlap areas by the action of the laser beam.

19. A method for manufacturing a data carrier having a security element, in which a) a print image is imprinted on a data carrier substrate, b) a laser marking at least partially overlapping the print image is created by a first laser action register variations existing between the print image and the laser marking, and c) in addition to the laser marking, by a second laser action is produced, in register with the laser marking, a laser modification; wherein the laser modification is at least partially overlapping the print image, and in the overlap area of the laser modification and the print image, the visual appearance of the print image is modified; wherein the print image, the laser marking, and the laser modification are arranged on the same side of the data carrier; and wherein the laser modification is produced in the form of a surrounding contour of predefined width around the entire circumferential edge of the print image.

20. The method according to claim 19, characterized in that the laser marking is produced in step b) having register variations between the print image and the laser marking, and the laser modification is produced in step c) having a characteristic dimension that is matched to the size of the register variations, wherein the characteristic dimension is a predefined width of the surrounding contour.

21. The method according to claim 19, characterized in that the print image is imprinted by means of screen printing, offset printing or relief printing.

22. The method according to claim 19, characterized in that the laser marking and the laser modification are produced by a laser marker in the same operation with the same laser marker.

23. The method according to claim 19, characterized in that the laser marking and/or the laser modification are produced with varying laser beam parameters such that different effects or different effect intensities are achieved.

24. The method according to claim 19, characterized in that the laser modification is first produced, and the laser marking is then produced at least partially within the laser modification.

25. The method according to claim 19, characterized in that the laser marking and the laser modification are produced for a plurality of individual ups of data carriers on a sheet or a roll.

26. The method according to claim 19, characterized in that, to produce the laser marking and/or the laser modification, an infrared laser in the wavelength range from 0.8 μm to 3 μm is used.

27. The method according to claim 19, characterized in that, for marking, the laser beam is guided across the data carrier material at a speed of more than 1000 mm/s.

* * * * *